US008944574B2

(12) United States Patent
Rijfers et al.

(10) Patent No.: US 8,944,574 B2
(45) Date of Patent: Feb. 3, 2015

(54) DROPLET BREAK-UP DEVICE

(75) Inventors: Andries Rijfers, Kamerik (NL); René Jos Houben, Nederweert (NL); Leonardus Antonius Maria Brouwers, Beesel (NL)

(73) Assignee: Nederlandse Organisatie Voor Toegepast-Natuurwetenschappelijk Onderzoek TNO, Delft (NL)

( * ) Notice: Subject to any disclaimer, the term of this patent is extended or adjusted under 35 U.S.C. 154(b) by 971 days.

(21) Appl. No.: 12/742,234

(22) PCT Filed: Nov. 10, 2008

(86) PCT No.: PCT/NL2008/050716

§ 371 (c)(1),
(2), (4) Date: Jul. 28, 2010

(87) PCT Pub. No.: WO2009/061202

PCT Pub. Date: May 14, 2009

(65) Prior Publication Data

US 2010/0295904 A1 Nov. 25, 2010

(30) Foreign Application Priority Data

Nov. 9, 2007 (EP) ..... 07120339

(51) Int. Cl.
*B41J 2/03* (2006.01)

(52) U.S. Cl.
CPC ..... *B41J 2/03* (2013.01); *B41J 2202/15* (2013.01)
USPC ..... 347/75; 347/84

(58) Field of Classification Search
None
See application file for complete search history.

(56) References Cited

U.S. PATENT DOCUMENTS

| | | | |
|---|---|---|---|
| 3,709,432 | A | 1/1973 | Robertson |
| 3,958,249 | A | 5/1976 | Demaine et al. |
| 4,190,844 | A | 2/1980 | Taylor |
| 4,341,310 | A | 7/1982 | Sangiovanni et al. |
| 4,914,522 | A | 4/1990 | Duffield et al. |
| 5,180,065 | A | 1/1993 | Touge et al. |
| 5,838,350 | A | 11/1998 | Newcombe et al. |
| 5,907,338 | A | 5/1999 | Burr et al. |
| 6,200,013 | B1 | 3/2001 | Takeuchi et al. |

(Continued)

FOREIGN PATENT DOCUMENTS

| | | |
|---|---|---|
| CN | 1266783 | 9/2000 |
| CN | 101048283 | 10/2007 |

(Continued)

OTHER PUBLICATIONS

International Search Report issued in PCT/NL2008/050716 dated Jan. 5, 2009.

(Continued)

*Primary Examiner* — Jerry Rahll
(74) *Attorney, Agent, or Firm* — Knobbe, Martens, Olson & Bear, LLP

(57) ABSTRACT

The invention relates to a droplet break up device comprising: a chamber for containing a printing liquid comprising a bottom plate; a pump for pressurizing the printing liquid; an outlet channel having a central axis, provided in said chamber for ejecting the printing liquid; and an actuator for breaking up a fluid jetted out of the outlet channel. The actuator is provided around the outlet channel, arranged to symmetrically impart a pressure pulse central to the outlet channel axis. Accordingly, smaller droplets can be delivered at higher frequencies.

16 Claims, 8 Drawing Sheets

(56) References Cited

U.S. PATENT DOCUMENTS

| | | | | |
|---|---|---|---|---|
| 6,291,927 | B1 | 9/2001 | Percin et al. | |
| 6,299,288 | B1 | 10/2001 | Abeywardane et al. | |
| 6,357,866 | B1 | 3/2002 | van Rensburg | |
| 6,505,920 | B1 * | 1/2003 | Braun | 347/75 |
| 8,544,974 | B2 | 10/2013 | Boot et al. | |
| 2007/0279467 | A1 | 12/2007 | Regan et al. | |
| 2007/0296773 | A1 | 12/2007 | Sharma et al. | |

FOREIGN PATENT DOCUMENTS

| | | | |
|---|---|---|---|
| EP | 0 011 170 | A | 5/1980 |
| EP | 0 422 616 | A | 4/1991 |
| EP | 0 943 436 | A | 9/1999 |
| EP | 1 219 431 | A | 7/2002 |
| EP | 1 228 874 | A | 8/2002 |
| EP | 1 398 155 | A | 3/2004 |
| EP | 1 637 329 | A | 3/2006 |
| GB | 1 521 874 | A | 8/1978 |
| GB | 2 041 831 | A | 9/1980 |
| GB | 1 598 779 | A | 9/1981 |
| JP | 50-51631 | A | 5/1975 |
| JP | 53134434 | A | 11/1978 |
| JP | 3101365 | A | 4/1991 |
| JP | 5185635 | A | 7/1993 |
| JP | 5-229126 | A | 9/1993 |
| JP | 07-314665 | A | 5/1995 |
| JP | 8258271 | A | 10/1996 |
| JP | 2005-254579 | | 9/2005 |
| WO | 2004/011154 | A2 | 2/2004 |
| WO | 2006/038979 | A1 | 4/2006 |
| WO | WO 2006/101386 | A | 9/2006 |

OTHER PUBLICATIONS

International Search Report issued in PCT/NL2008/050707 dated Feb. 4, 2009.

* cited by examiner

DROPLET BREAK-UP DEVICE

This application is the U.S. National Phase of International Application No. PCT/NL2008/050716, filed Nov. 10, 2008, designating the U.S. and published in English as WO 2009/061202 on May 14, 2009 which claims the benefit of European Patent Application No. 07120339.2 filed Nov. 9, 2007.

FIELD OF THE INVENTION

The invention relates to a droplet break-up device, in the art known as a drop on demand system or a continuous printing system, configured for ejecting droplets from a printing nozzle in various modes. In this respect, the term "printing" generally refers to the generation of small droplets and is—in particular, not limited to generation of images.

In this connection, by a continuous jet printing technique is meant the continuous generation of drops which can be utilized selectively for the purpose of a predetermined droplet generation process. The supply of drops takes place continuously, in contrast to the so-called drop-on-demand technique whereby drops are generated according to the predetermined droplet generation process.

BACKGROUND OF THE INVENTION

A known apparatus is described, for instance, in WO2004/011154. This document discloses a so-called continuous jet printer for generation of droplets from materials comprising fluids. With this printer, fluids can be printed. During the exit of the fluid through an outlet channel, a pressure regulating mechanism provides a disturbance of the fluid adjacent the outflow opening. This leads to the occurrence of a disturbance in the fluid jet flowing out of the outflow opening. This disturbance leads to a constriction of the jet which in turn leads to a breaking up of the jet into drops. This yields a continuous flow of egressive drops with a uniform distribution of properties such as dimensions of the drops. The actuator is provided as a vibrating bottom plate. However, due to the dimensioning of the bottom plate, higher frequencies are difficult to attain.

SUMMARY OF THE INVENTION

In one aspect, the invention aims to provide a break-up device that provides smaller droplets at higher frequencies, to overcome the limitations of current systems.

DETAILED DESCRIPTION OF THE EMBODIMENTS

According to an aspect of the invention, a droplet break up device is provided comprising: a chamber for containing a pressurized printing liquid comprising a bottom plate; at least one outlet channel having a central axis, provided in said chamber for ejecting the printing liquid; and an actuator for breaking up a fluid jet ejected out of the outlet channel in droplets; wherein the actuator is provided symmetric respective to the outlet channel central axis, arranged to impart a pressure pulse to the fluid jet symmetric respective to the outlet channel central axis.

According to another aspect of the invention, a method of ejecting droplets for printing purposes is provided, comprising: providing a chamber for containing a printing liquid comprising a bottom plate, a pump for pressurizing the printing liquid, and an outlet channel in the chamber having a central axis; and imparting a pressure pulse to the liquid near the outlet channel so as to break up a fluid jetted out of the outlet channel; wherein the pressure pulse is imparted by a bottom plate movement axially or radially symmetric respective to the outlet channel central axis.

Accordingly, the eigenfrequency of the break up system can be increased, leading to higher working frequencies and smaller droplets. Without limitation, frequencies and droplets may be in the order of 5 kHz to 20 MHz, with droplets smaller than 50 micron.

In addition, by virtue of high pressure, fluids may be printed having a particularly high viscosity such as, for instance, viscous fluids having a viscosity of $300 \cdot 10^{-3}$ Pa·s when being processed. In particular, the predetermined pressure may be a pressure between 0.5 and 600 bars.

Figure 1:
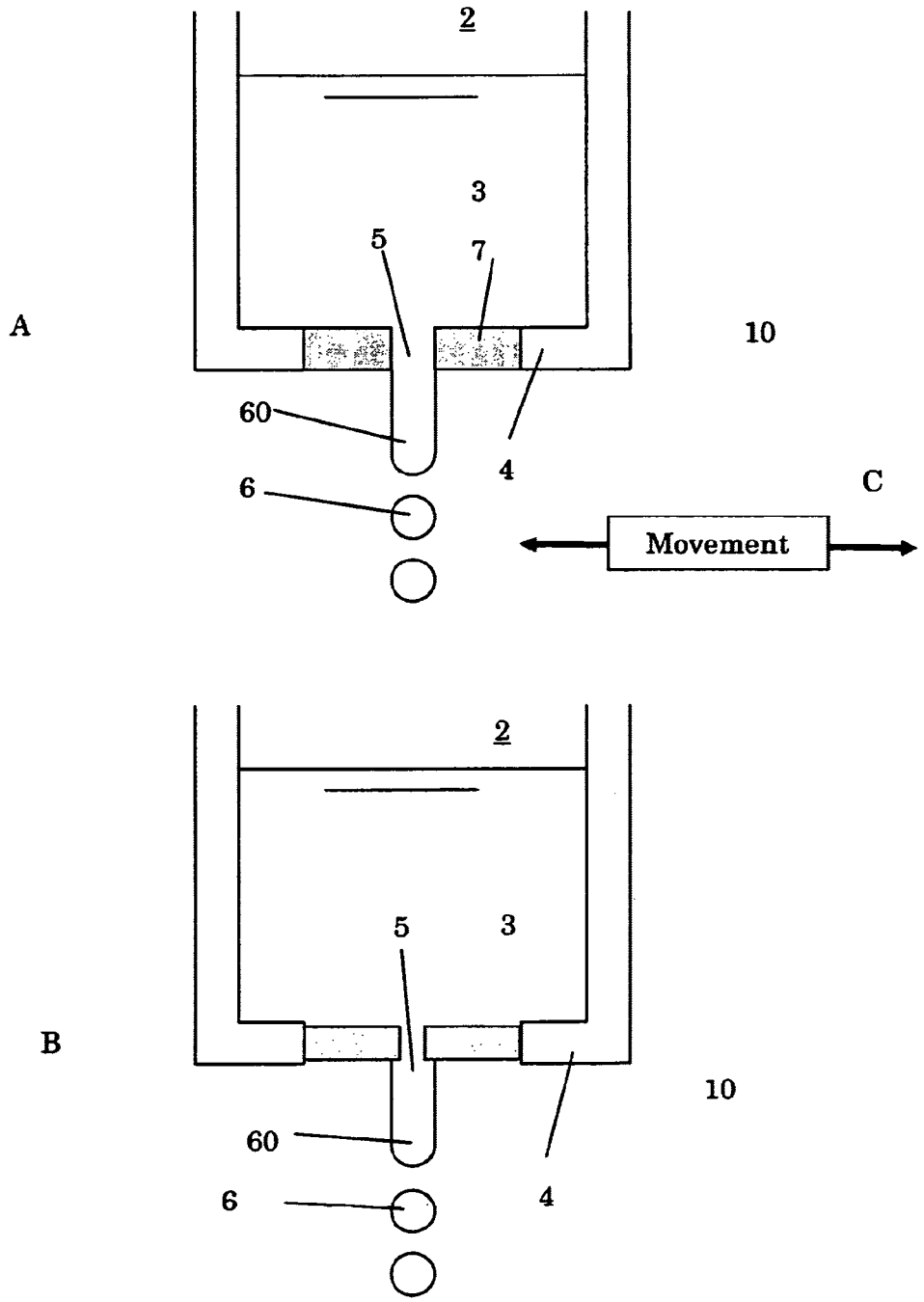
FIG. 1 shows schematically a first embodiment of a droplet generation system for use in the present invention.
Figure 2:
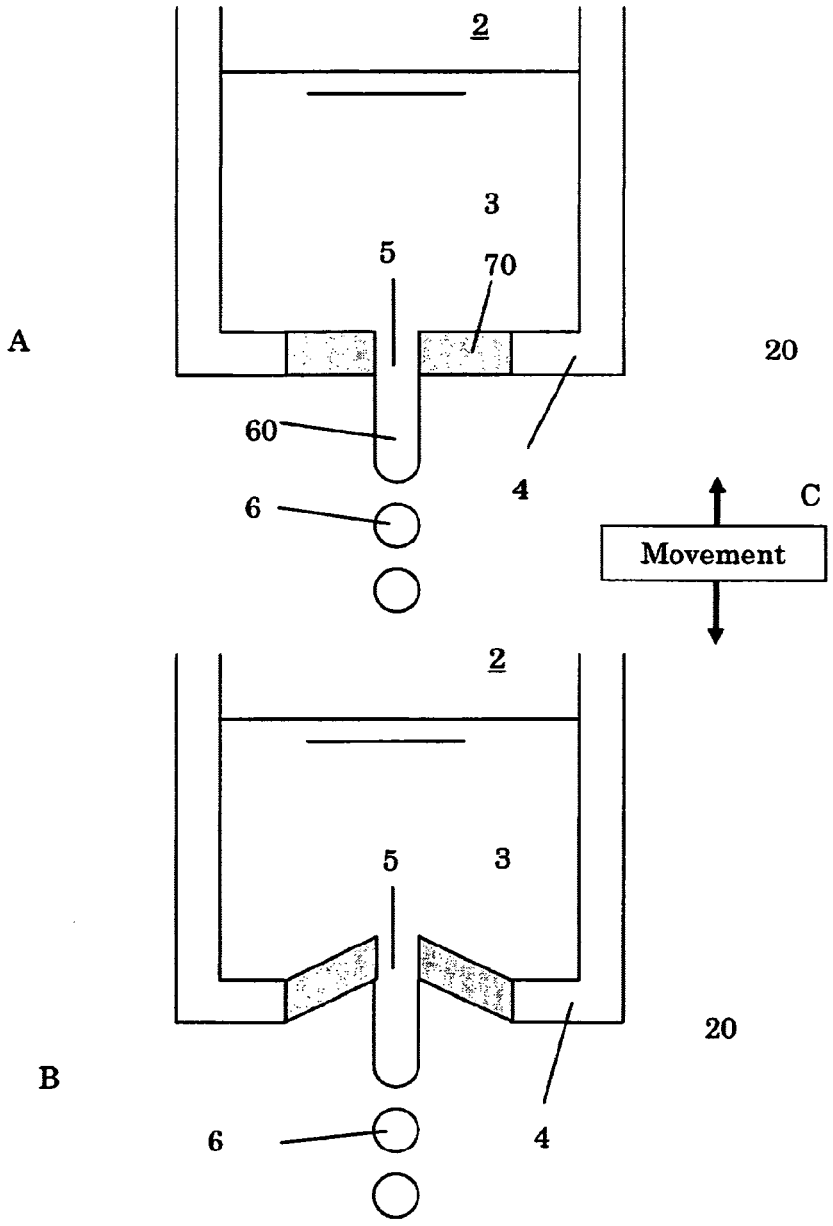
FIG. 2 shows schematically a second embodiment of a droplet generation system for use in the present invention.
Figure 3:
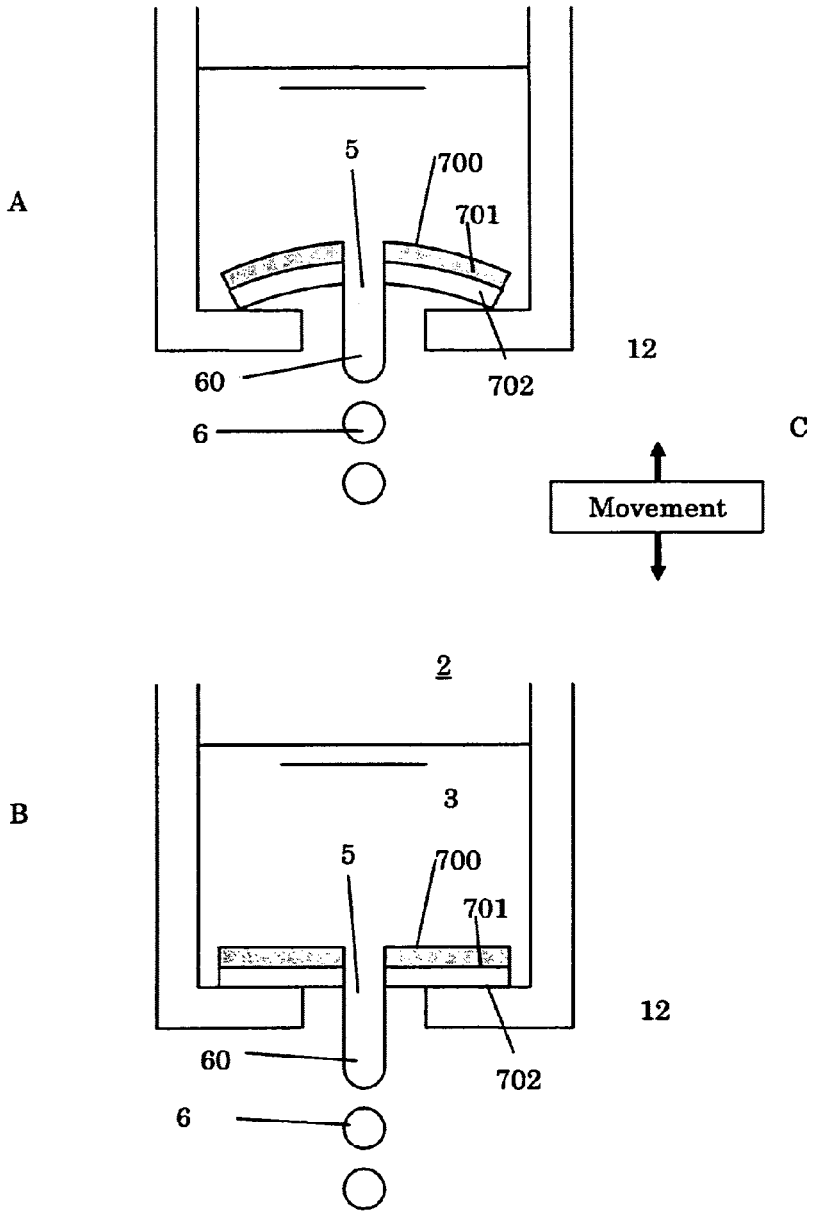
FIG. 3 shows schematically a third embodiment of a droplet generation system for use in the present invention.
Figure 4:
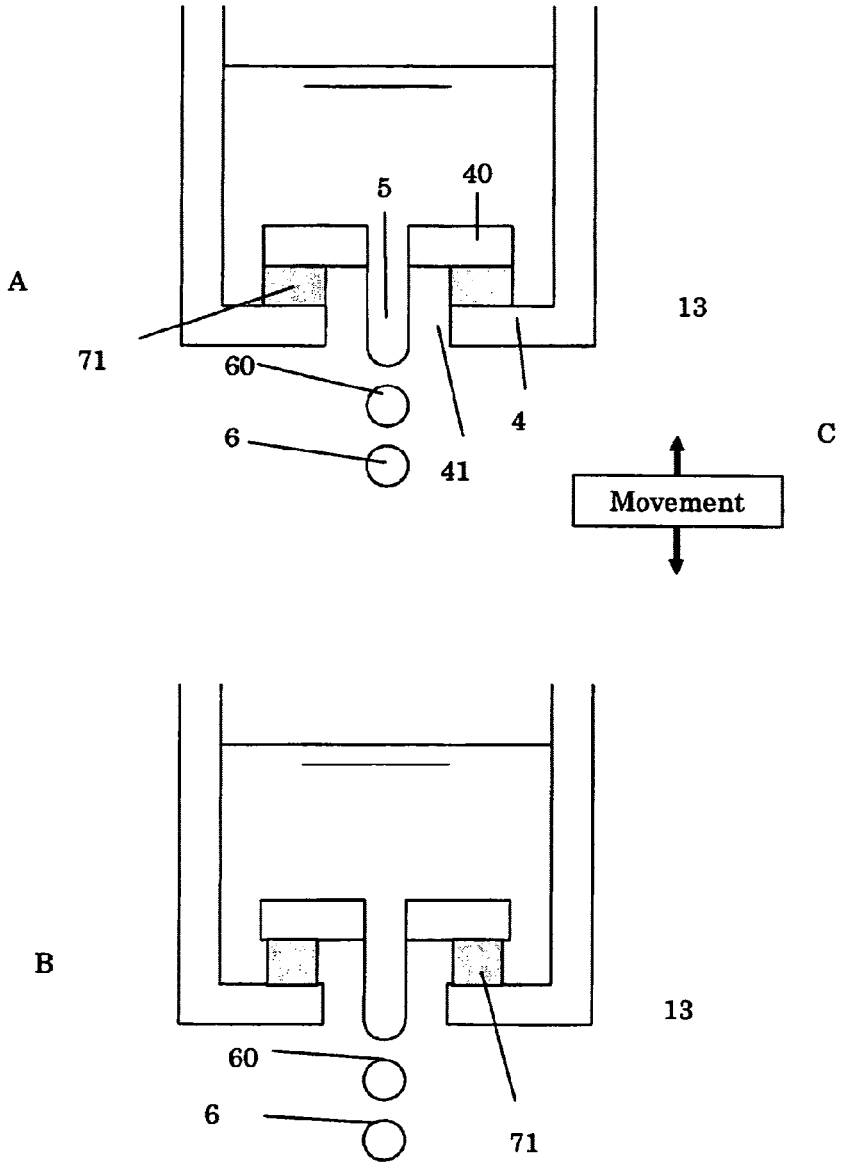
FIG. 4 shows schematically a fourth embodiment of a droplet generation system for use in the present invention.
Figure 5:
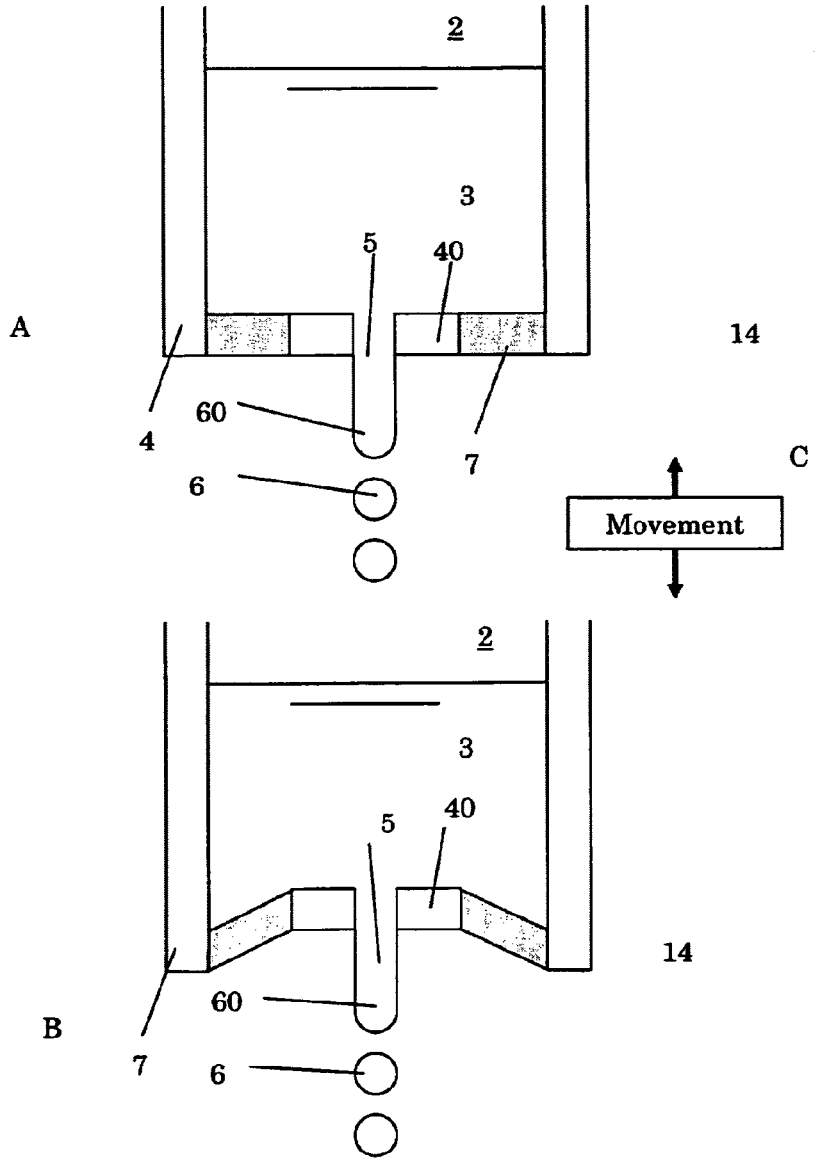
FIG. 5 shows a detailed view of a contraction of the outlet channel.

Other features and advantages will be apparent from the description, in conjunction with the annexed drawings, wherein:

FIG. 1 shows schematically a first embodiment of a droplet generation system for use in the present invention;

FIG. 2 shows schematically a second embodiment of a droplet generation system for use in the present invention;

FIG. 3 shows schematically a third embodiment of a droplet generation system for use in the present invention;

FIG. 4 shows schematically a fourth embodiment of a droplet generation system for use in the present invention;

FIG. 5 shows a detailed view of a contraction of the outlet channel; and

Figure 6:
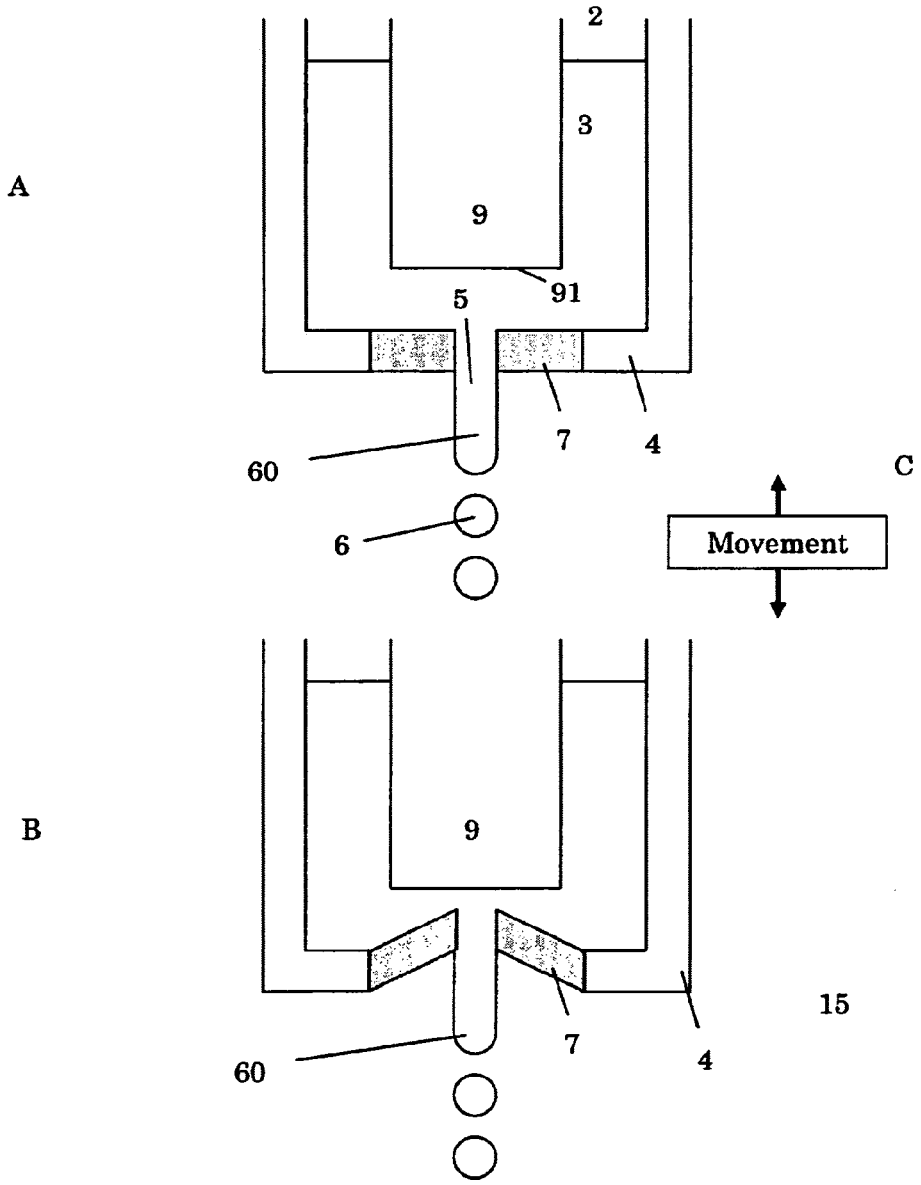
FIG. 6 shows schematically a fifth embodiment of a droplet generation system for use in the present invention.
Figure 7:
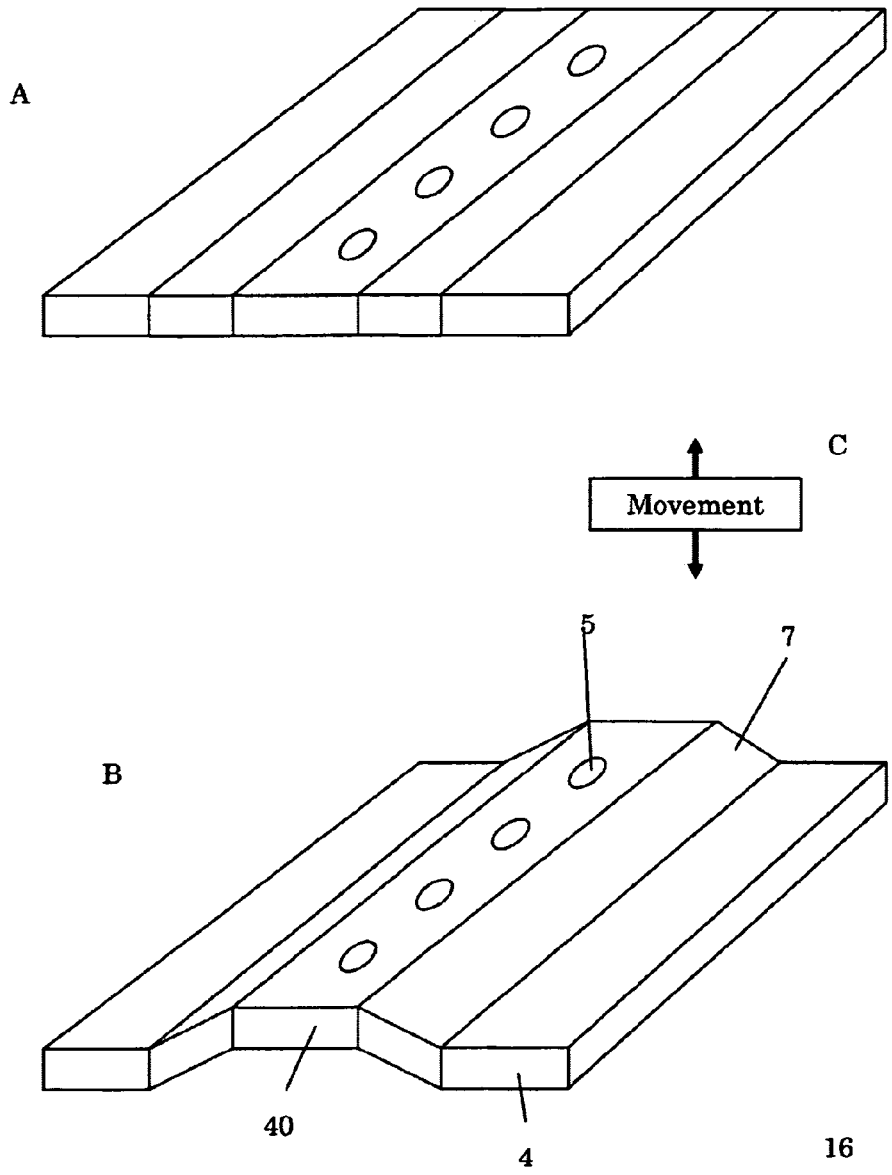
FIGS. 7 and 8 show the inventive principle by an actuator mechanically connected to the outlet channel for a plurality of outlet channels.
Figure 8:
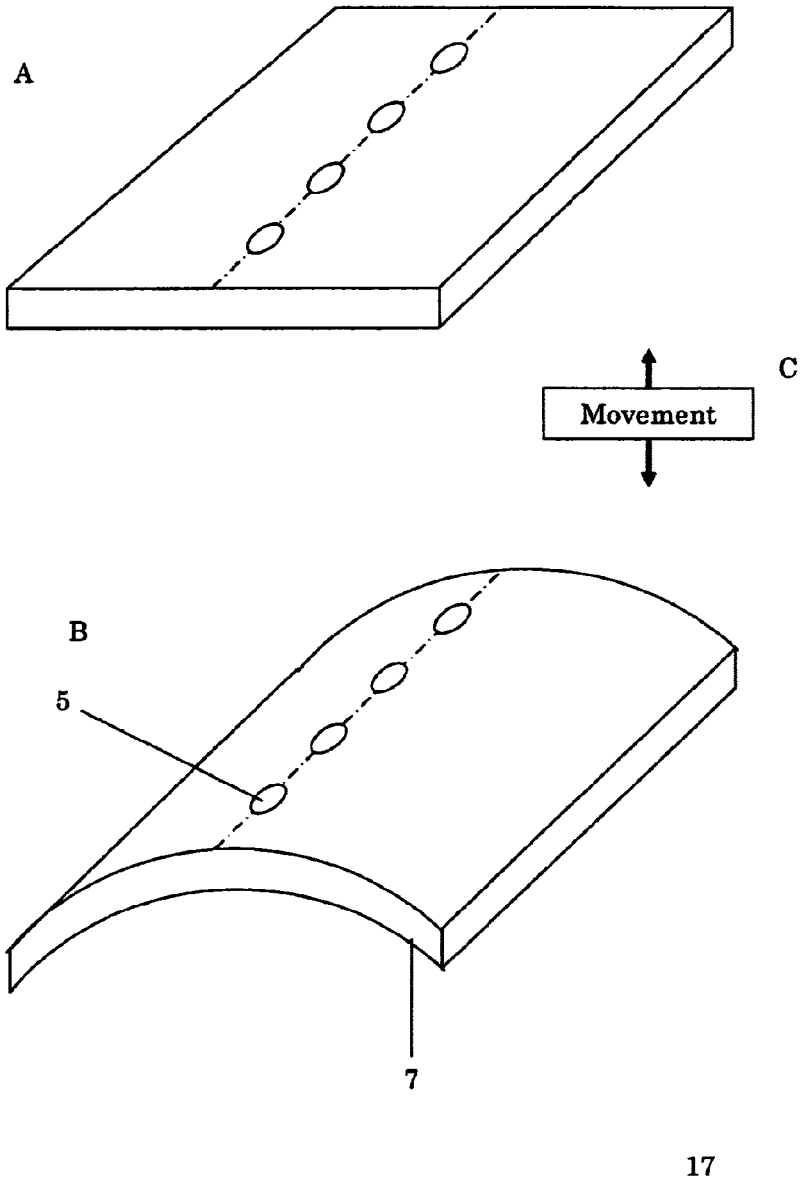

FIG. 6 shows schematically a fifth embodiment of a droplet generation system for use in the present invention; and FIGS. 7 and 8 show the inventive principle by an actuator mechanically connected to the outlet channel for a plurality of outlet channels.

In the following parts A, B and C denote respective operating positions of the actuator and the actuation direction.

FIG. 1 shows a first schematic embodiment of a droplet break up device according to the invention. In particular the droplet break up device 10, also indicated as printhead, comprises a chamber 2, comprising a bottom plate 4. Chamber 2 is suited for containing a pressurized liquid 3, for instance pressurized via a pump or via a pressurized supply (not shown). The chamber 2 comprises an outlet channel 5 through which a pressurized fluid jet 60 breaks up in droplets 6. The outlet channel defines a central axis and actuator 7 is formed around the outlet channel, substantially symmetric to the central axis of the outlet channel 5. The actuator is preferably a piezo-electric or magnetostrictive member in the form of an annular disk provided in the bottom plate 4. By actuation of the actuator 7, a pressure pulse is formed that is symmetric respective to the outlet channel axis 5. Accordingly droplets 6 are correctly formed in a symmetric way and smaller monodisperse droplets can be attained. In the embodiment of FIG. 1 the outlet channel 5 is arranged central to the actuating element 7 wherein the walls of the outlet channel 5 are formed by the actuating material.

In this example, the outflow opening 5 is included in actuator 7, which is provided in bottom plate 4. The outflow opening 5 in the plate 4 has a diameter of 50 μm in this example. A transverse dimension of the outflow opening 5 can be in the interval of 5-250 μm. As an indication of the size of the pressure regulating range, it may serve as an example that at an average pressure in the order of magnitude of 0.5-600 bars [≡0.5-600×$10^5$ Pa]. The printhead 10 may be further provided with a supporting plate (not shown) which supports the nozzle plate 4, so that it does not collapse under the high pressure in the chamber. In the embodiment of FIG. 1 the piezoelectric actuator 7, as schematically illustrated in part C is actuated in a push mode that is the actuation results in an axial deformation along the electric field. Accordingly the deformation is in plane with respect to bottom plate 4.

FIG. 2 shows an alternative embodiment 20 of the droplet break up device 10 illustrated in FIG. 1. For simplicity, like or corresponding elements will not be discussed in subsequent figures which are similar to FIG. 1. In FIG. 1, the actuating element 7 primarily induces a contraction of the outlet channel 5. In contrast, the FIG. 2 embodiment 20 provides an actuating element 70 that is central respective to the outlet channel 5, wherein the member 70 operates in shear mode to deform in an out-of-plane direction respective to the bottom plate 4. In FIG. 2C, the actuation direction is shown to be lateral with respect to the planar orientation of the actuator 70. This shear mode actuation is provided by an electric field inducing a shear deformation of the piezo-electric element. By actuating movement of the piezo-electric member 70, respective to the outlet channel central axis 5, the droplets 6 are formed from fluid jet 60. By suitable dimensioning the actuator mass can be very minimal and accordingly the droplets size can be well below 50 micron. The actuating element 70 is preferably a piezo-electric member but also other types of movers may be feasible such a magnetostrictive member or electromagnetic actuation via a coil.

In the embodiment of FIG. 3 the actuator 700 is provided as a sandwich piezo device which will result in a bending movement along an axial direction of outlet channel 5 due to different deformation properties of the sandwich layers 701 and 702 of the actuator 700. Accordingly a symmetric actuation along the central axis is provided by the sandwiched actuator 700 resulting in bending deformation. As in the example of the FIG. 2, the actuation direction in part C is indicated as lateral respective to the planar actuator 700.

Where in FIGS. 1, 2 and 3 the actuator is formed integrated in the bottom plate 4, in FIG. 4 an alternative arrangement is provided for a actuator provided symmetric respective to the outlet channel 5. In this embodiment, the outlet channel is provided in a metal foil 40 which is connected to angular piezo member 71. Parts A, B and C denote respective operating positions of the actuator 71 and the actuation direction, which in this embodiment is lateral to the central bottom plate 4. In this embodiment an arrangement is provided of a bottom plate 4 having an opening 41 in it, and actuation piezo layer 71 provided on and around such bottom plate opening 41, and a thin metal foil comprising the outlet channel 5, thus forming a nozzle plate 40 stacked on top of the actuating layer 71. In operation the actuating layer 71 will induce a lateral movement of the nozzle plate 40, thus imparting a symmetric pressure pulse in axial direction to the fluid jet 60.

Turning to FIG. 5, an alternative embodiment 14 is shown wherein in FIG. 5 the walls of the outlet channel 5 are formed by a nozzle plate 40 and the magnetostrictive or piezo-electric member 7 is arranged around the walls in bottom plate 4'. Actuator 7 may be attached on the bottom plate 4 or partly embedded in bottom plate 4 or fully integrated in bottom plate 4. The actuation may be axially respective to the outlet channel and/or radially respective to the outlet channel central axis by operating piezo actuator 7 in shear bending mode as shown in FIG. 5 part B.

Accordingly in the above, a method of generating droplets 6 is illustrated, for example, for deposition of droplets on a substrate, comprising providing a chamber 2 for containing a printing liquid 3, the chamber comprising a bottom plate 4 and an outlet channel 5 provided in the chamber having a central axis. The method further comprises imparting a pressure pulse to the liquid 3 near the outlet channel 5 for breaking up a fluid jetted out of the outlet channel 5 in the form of droplets 6. According to an aspect of the invention a pressure pulse is imparted by a bottom plate movement that is axially or radially symmetric respective to the outlet channel central axis. Alternative to the arrangements of FIGS. 1-5 or in addition to it, FIG. 6 shows a fifth embodiment of a droplet break up device 15. In this arrangement the piezo-electric member 7 is arranged to deflect in a shear mode actuation, which results in an axial movement of the outlet channel 5. In addition, FIG. 6 shows a focus member 9 provided concentrically to the outlet channel 5. Focus member is for example provided by a static pin. The bottom 91 is distanced preferably typically close to the outlet channel 5, for instance in a interval of 1-500 micron through the outlet channel for pressures in a range larger than 50 bar; typically, the distance can be related to about 10% of the outlet channel diameters. For lower pressures the focusing member may be provided by a little further away, typically for instance 100-1500 micron for the outlet channel. In the embodiment shown in FIGS. 1-6 the outlet channel is typically having a diameter of 5-250 micron, and a length of about 0.01-3 millimeter.

For instance, for a channel diameter of around 80 micron, a pin diameter may be in the order of 3 millimeter—for example a diameter between 2 and 3.5 millimeter. In a model using Newtonian fluids a pressure p in a cylindrical nozzle can be calculated in the nozzle:

$$p(r) = \begin{cases} \frac{3\mu v_{piezo}}{h_{gap}^3}(r_{piezo}^2 - r^2) + \frac{6\mu}{\pi h_{gap}^3} q_{nozzle} \ln\left(\frac{r}{r_{piezo}}\right) + p_{pump} & r_{nozzle} < r \le r_{piezo} \\ = p(r_{nozzle}) & r \le r_{nozzle} \end{cases} \quad (1)$$

Here, μ is a viscosity, for instance in a range of 3-300 mPa s; $u_{piezo}$ a calculated nozzle actuator speed; $p_{pump}$ a pump pressure, in a range of 0.5-600 bar; $r_{piezo}$ a focusing member diameter and $h_{gap}$ a gap distance of for instance 1-500 micron; and $q_{nozzle}$ a calculated flow variation through the nozzle. Integrating the pressure over the focusing member diameter, it can be shown that a relative force exerted between focusing member and nozzle is strongly dependent on diameter (in this example, using a diameter of 3.3 mm as standard):

| Unit | Diameter focussing member *0.9 | Standard | *1.1 | Dimension |
|---|---|---|---|---|
| Maximal force | 27 | 37 | 50 | N |
| Minimal force | 3 | 0 | 5 | N |
| Maximal flow | 1.0 | 1.0 | 1.2 | ml $s^{-1}$ |
| Minimal flow | −0.3 | −0.4 | −0.5 | ml $s^{-1}$ |
| Maximal pressure | 2.7 | 2.9 | 3.1 | MPa |
| Maximal stiffness increase | 0.2 | 2.2 | 3.3 | MN $m^{-1}$ |

Accordingly, a focus member having a limited diameter that is provided concentrically to the outlet channel and having a bottom distanced from the outlet channel, for focusing the pressure pulse near the outlet channel may provide more effective droplet break up while reducing the forces exerted on the nozzle actuator.

The distance interval in which the focusing member, in the form of a static pin, is operatively arranged may depend on the viscosity of the fluid. For droplet generation from fluids having a high viscosity, the distance from the end to the outflow opening is preferably relatively small. For systems that work with pressures up to 5 Bars [$\equiv 5\cdot 10^5$ Pa], this distance is, for instance, in the order of 0.5 mm. For higher pressures, this distance is preferably considerably smaller. For particular applications where a viscous fluid having a particularly high viscosity of, for instance, $300\text{-}900\cdot 10^3$ Pa·s, is printed, depending on outlet channel diameter, an interval distance of 15-30 μm can be used. The static pin preferably has a relatively small focusing surface area per nozzle, for instance 1-5 mm2.

From the forgoing it may be clear that the focus member 9 illustrated in the embodiment of FIG. 6 may also be an applied the embodiments where axial movement of the outlet channel 5 is induced in particular the embodiment of FIG. 2, FIG. 3, FIG. 4 and FIG. 5. Also in the embodiment of FIG. 1, wherein a contraction of the outlet channel is provided, focusing member 9 may be of use. In addition, it may be clear from the forgoing that the actuation principles of FIG. 1-6 may be applied in various combinations, for instance a contraction combined with an axial movement or a bending movement of a piezo actuator 7. Also, from the forgoing it may be clear that the actuator is not limited to piezo actuator may also include other actuators such as magnetostrictic actuators.

The embodiments of FIG. 7 and FIG. 8 finally show the inventive principle of providing a symmetric pressure pulse by an actuator mechanically connected to the outlet channel for a plurality of outlet channels 5. In particular, the arrangement of FIG. 7 shows a schematic perspective view of an out-of plane extension of the FIG. 5 embodiment, wherein several outlet channels are provided in a nozzle plate 5, which is actuated by shear movement of a piezo electric actuator 7 mechanically connected to a bottom plate 4. By shear bending actuation, the nozzle plate 40 moves in axial direction respective to the outlet channel 5.

Likewise the FIG. 7 embodiment shows an out-of-plate extension of the embodiment described with reference to FIG. 3. In this embodiment a bending movement is provided in an actuator 7 comprising a plurality of outlet channels 5. By bending the actuator the outlet channels are vibrated in axial direction. Accordingly the inventive principle can be applied for a plurality of outlet channels.

The invention has been described on the basis of an exemplary embodiment, but is not in any way limited to this embodiment. Diverse variations also falling within the scope of the invention are possible. To be considered, for instance, are the provision of regulable heating element for heating the viscous printing liquid in the channel, for instance, in a temperature range of −20 to 1300° C., more preferably between 10 to 500° C. By regulating the temperature of the fluid, the fluid can acquire a particular viscosity for the purpose of processing (printing). This makes it possible to print viscous fluids such as different kinds of plastic and also metals (such as solder).

What is claimed is:

1. A droplet break up device comprising:

a chamber for containing a pressurized printing liquid, wherein the chamber comprises a bottom plate;

at least one outlet channel having a central axis, located in said chamber for ejecting the printing liquid; and an actuator mechanically connected to the outlet channel for breaking up a fluid jet ejected out of the outlet channel in droplets;

wherein the actuator is configured to be symmetric respective to the outlet channel central axis, and wherein the actuator is configured to impart a pressure pulse to the fluid jet symmetric respective to the outlet channel central axis;

wherein a focus member is located in the chamber concentrically to the outlet channel and comprises a bottom distanced in an interval distance of 1-500 microns from the outlet channel for focusing the pressure pulse near the outlet channel.

2. A droplet break up device according to claim 1, wherein the actuator is located in the bottom plate.

3. A droplet break up device according to claim 2, wherein the outlet channel is arranged in the actuator.

4. A droplet break up device according to claim 1, wherein the actuating member is annular and concentrically arranged around the outlet channel, the member attached to a chamber wall and to the bottom plate on opposite sides.

5. A droplet break up device according to claim 1, wherein the actuator acts as a piezo-electric or magnetostrictive member.

6. A droplet break up device according to claim 1, wherein the actuator is configured to actuate the outlet channel axially.

7. A droplet break up device, according to claim 1 wherein the actuator is configured to generate a contraction of the liquid channel.

8. A droplet break up device to claim 1, wherein the bottom plate comprises an extending part that is configured to bend or shear axially respective to the outlet channel.

9. A droplet break up device according to claim 1, wherein the focus member comprises a static pin.

10. A droplet break up device according to claim 1, wherein the diameter of the outlet channel is in the interval of 5-250 micron.

11. A droplet break up device according to claim 1, wherein the outlet channel length is in the interval of 0.01-3 millimeter.

12. A method of ejecting droplets, comprising:

providing a chamber for containing a printing liquid comprising a bottom plate, a pump for pressurizing the printing liquid, an outlet channel in the chamber having a central axis, and a focus member located in the chamber concentrically to the outlet channel and comprising a bottom distanced in an interval distance of 1-500 microns from the outlet channel; and imparting a pressure pulse to the liquid near the outlet channel so as to break up a fluid jetted out of the outlet channel;

wherein the pressure pulse is imparted by a bottom plate movement axially or radially symmetric respective to the outlet channel central axis; and wherein the focus member is configured to focus the pressure pulse near the outlet channel.

13. A method according to claim 12, wherein the bottom plate movement is caused by contraction of the outlet channel.

14. A method according to claim 12, wherein the outlet channel movement is caused by axial vibration along the outlet channel axis.

15. A method according to claim 12, wherein the movement is caused by a piezo-electric or magnetostrictic actuation element located in the bottom plate.

16. A method according to claim 15, wherein the actuation element is located symmetrically around the outlet channel central axis.

* * * * *